US005398587A

United States Patent [19]

Kornblith

[11] Patent Number: 5,398,587

[45] Date of Patent: Mar. 21, 1995

[54] GAS-PROPELLED LINE DEPLOYMENT SYSTEM

[75] Inventor: Jeffrey S. Kornblith, Mystic, Conn.

[73] Assignee: The United States of America as represented by the Secretary of the Navy, Washington, D.C.

[21] Appl. No.: 216,862

[22] Filed: Mar. 23, 1994

[51] Int. Cl.[6] ..... F42B 12/68

[52] U.S. Cl. ..... 89/1.34; 102/504

[58] Field of Search ..... 89/1.34, 1.816; 102/504; 124/60, 71, 73

[56] References Cited

U.S. PATENT DOCUMENTS

| | | | |
|---|---|---|---|
| 175,742 | 4/1876 | Parrott | 89/1.34 |
| 325,608 | 9/1885 | Hunter | 102/504 |
| 372,958 | 11/1887 | Bradley et al. | 102/504 |
| 1,072,969 | 9/1913 | McCreary | 89/1.34 |
| 1,418,963 | 6/1922 | Norman | 89/1.34 |
| 3,382,859 | 5/1968 | Myers | 124/60 |
| 3,523,538 | 8/1970 | Shimizu | 42/84 |
| 3,780,720 | 12/1973 | Alderson | 124/60 |
| 4,741,243 | 5/1988 | Snider | 89/1.34 |
| 4,784,035 | 11/1988 | Fishfader et al. | 102/504 |

*Primary Examiner*—David Brown

*Attorney, Agent, or Firm*—Michael J. McGowan; Prithvi C. Lall; Michael F. Oglo

[57] ABSTRACT

A gas propelled line deployment system includes a launch tube, and a bullet-shaped projectile. The launch tube has a closed end with a gas port formed therein and an open end having a plurality of radially extending threaded apertures. The projectile has two spaced, circumferential grooves adjacent the blunt end thereof, with an O-ring mounted in one of the grooves. The projectile is slidably received in the launch tube with the blunt end adjacent the open end of the tube, i.e. the rounded end facing the close end, so that O-ring forms a gas tight seal adjacent the open tube end. Nylon retainer screws are threadedly received in the threaded apertures so that they engage within the other circumferential groove in the projectile. The line to be deployed is attached to an elastic band which is attached to the blunt end of the projectile. A carbon dioxide gas canister communicates with the gas port to introduce a pressurized gas flow into the tube. The gas entering the launch tube builds up a propulsion force which is operative for shearing the nylon retainer screws and propelling the projectile outwardly from the launch tube, deploying the line.

14 Claims, 3 Drawing Sheets

GAS-PROPELLED LINE DEPLOYMENT SYSTEM

STATEMENT OF GOVERNMENT INTEREST

The invention described herein may be manufactured and used by or for the Government of the United States of America for government purposes without payment of any royalties thereon or therefor.

BACKGROUND OF THE INVENTION (1) Field of the Invention

The instant invention relates to means for deploying a line or wire over the ground, and more particularly to a gas-propelled line deployment system.

(2) Description of the Prior Art

Means for deploying a line or wire along a particular path, or over the ground, have heretofore been known in the art. In this regard, the patents to Myers U.S. Pat. No. 3,382,859; Hudick U.S. Pat. No. 3,575,083; Hamrick et al U.S. Pat. No. 3,669,087; Alderson U.S. Pat. No. 3,780,720; Barret et al U.S. Pat. No. 4,653,379; and Pinson U.S. Pat. No. 4,770,370 represent the closest prior art to the subject invention of which the applicant is aware.

The Myers patent discloses a line throwing gun which propels a wire or line along an unconfined path. The gun comprises an elongated barrel with a hand grip, and a breech opening near the end of the barrel. The breech opening receives a conventional line package which comprises a pliable line wound in a cylindrical roll. The rear end of the barrel is provided with a coupling for connection to a source of compressed air. The gun is operated by admitting a short burst of compressed air into the gun which propels the line package through the tubular barrel and along a path determined by the position of the gun.

The patent to Hudick discloses a launch assembly and projectile for draping a thin copper wire across a tree for use as an antenna. The launcher comprises a metal tube with a conventional cartridge of solid grain rocket fuel. The projectile comprises a bobbin of wire with a nose cone, and the projectile is fitted onto one end of the metal tube. The loose end of the wire is anchored to the ground and the wire is paid out as the projectile ascends.

The patent to Hamrick et al discloses a gas-operated line throwing gun for casting a line package across a non-accessible area. The Hamrick gun operates in a similar manner to the Myers gun.

The patent to Alderson discloses a compressed air, spear projecting device which can be utilized for propelling spears under water. The Alderson device can also be utilized in connection with a casting rod for propelling a fishing lure.

The patent to Barret et al discloses a filament deployment system for artificially triggering lightening flashes. The system comprises a finned rocket which is launched from a launcher, and a reel assembly which pays out a thin conductive wire. The conductive wire is wound onto the pay-out reel, and the reel is mounted at the lower end of the rocket. The reel has a larger diameter than the body of the rocket and a smaller diameter than the guidance fins. The wire is anchored to the ground and it is paid out as the rocket ascends.

The patent to Pinson discloses an optical fiber guided projectile system, wherein an optical fiber is connected to a projectile to provide tracking information and two-way communication for receiving and processing target data.

SUMMARY OF THE INVENTION

The instant invention provides a gas-propelled line deployment system.

Briefly, the line deployment system comprises a tubular launch barrel having a closed end and an open end, and a projectile which is slidably received into the launch barrel. The closed end of the launch barrel includes a gas port which is connectible to a pressurized gas cartridge, and the open end includes a chamfered lip portion to facilitate insertion of the projectile into the barrel. A plurality of radially disposed, threaded apertures are provided adjacent to the open end of the barrel for receiving nylon retainer screws therein. The projectile is substantially bullet-shaped and it has a blunt end, a rounded end, and two circumferential grooves adjacent to the blunt end thereof. A resilient O-ring is received in one of the grooves. The projectile is snugly received into the barrel with the blunt end thereof adjacent to the open end of barrel. The O-ring is operative for forming a gas-tight seal between the projectile and the barrel. The nylon retainer screws are threadedly received in the radial apertures in the open end of the barrel so as to engage with the second circumferencial groove in the projectile. An elastic band is attached to the blunt end of the projectile, and a continuous length of line is attached to the elastic band. The pressurized gas canister provides a pressurized flow of gas into the barrel thereby creating a propulsion force inside the barrel which is operative for shearing the nylons screws and propelling the projectile outwardly of the launch barrel. The projectile pulls the attached line over the ground as it travels along its flight path. A mounting bracket is provided to support the launch barrel at a plurality of different launch angles.

Accordingly, it is an objective of the instant invention to provide a gas-propelled line deployment system.

It is another object to provide a compact projectile system which can be readily assembled and operated in a short period of time.

It is yet another object to provide a gas-propelled line deployment system which is capable of propelling a projectile to a distance of approximately 100 feet.

It is still another object to provide a gas-propelled line deployment system which is capable of deploying a line or propelling a projectile remotely, i.e., with operation in a different location from said deployment system.

Other objects, features and advantages of the invention shall become apparent as the description thereof proceeds when considered in connection with the accompanying illustrative drawings.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 5:
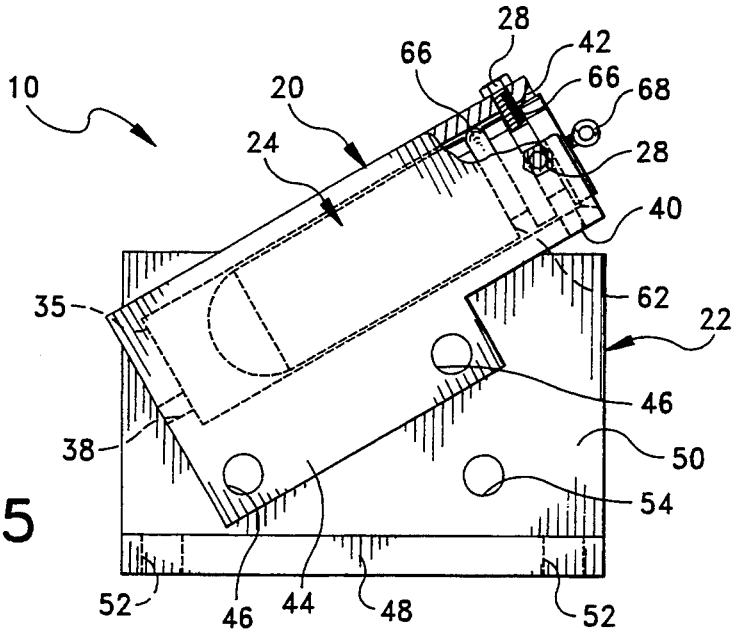
FIG. 5 is an elevational view, partially in section, showing the projectile mounted in the launch barrel.
Figure 6:
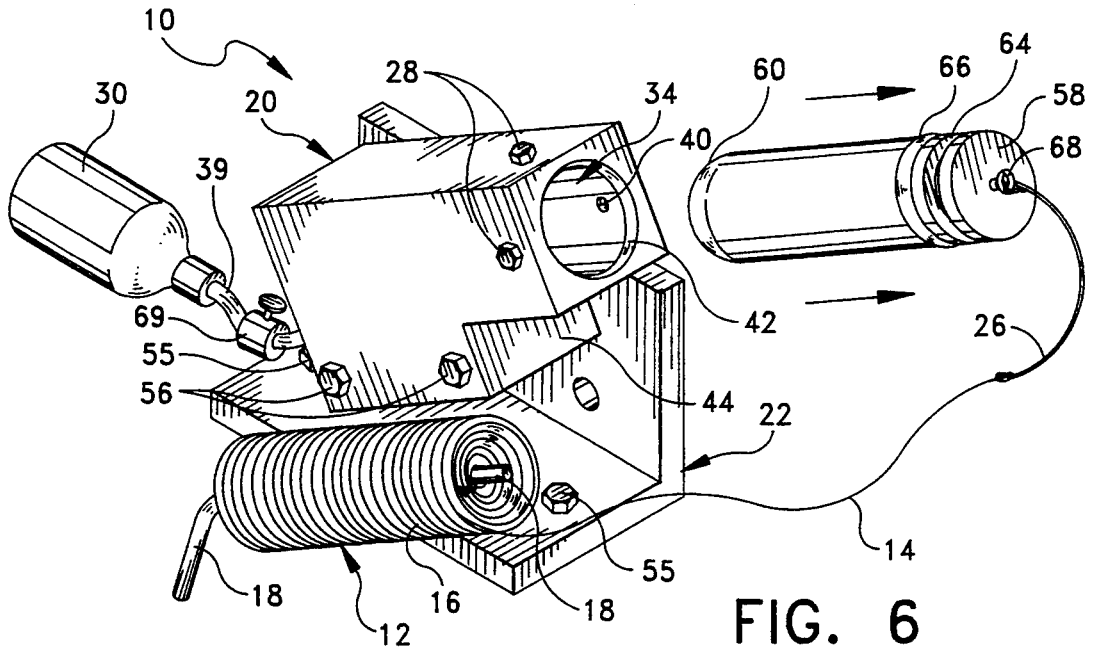
FIG. 6 is a perspective view of the gas-propelled line deployment system of the instant invention, with the projectile being ejected from the launch barrel.

Referring now to the drawings, the gas-propelled line deployment system of the instant invention is illustrated and generally indicated at 10 in FIGS. 5 and 6. As will hereinafter be more fully described, the system 10 is operative for deploying a continuous length of line, generally indicated at 12, to a distance of approximately 100 feet.

The continuous length of line 12 preferably comprises a multi-strand wire 14 which is wound onto a spool 16. The spool 16 is preferably mounted on an angled rod 18 which is securable by any conventional means to a supporting surface. When the wire 14 is pulled, it freely unravels from the spool 16.

Figure 1:
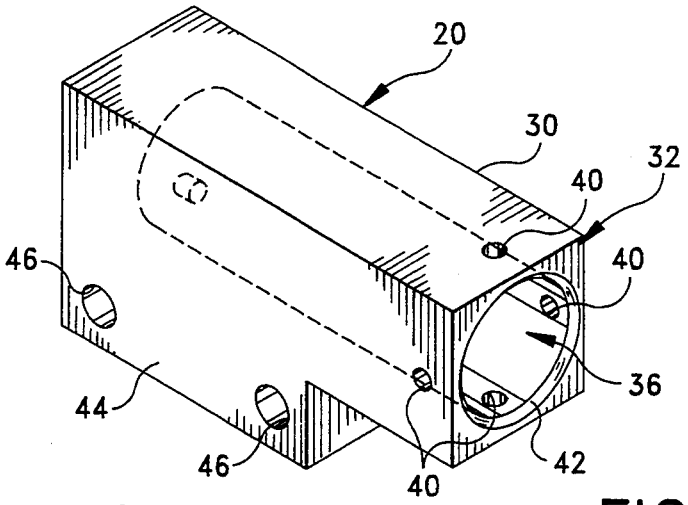
FIG. 1 is a front perspective view of the launch barrel of the instant invention.
Figure 2:
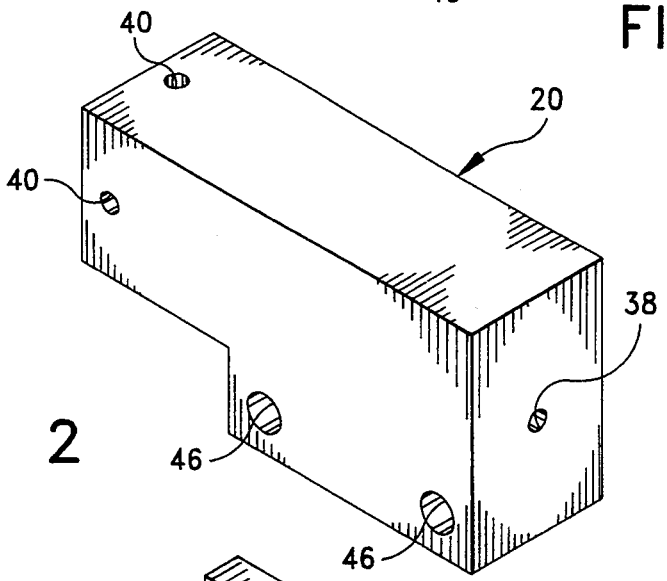
FIG. 2 is a rear perspective view thereof.

The instant deployment system 10 comprises a launch barrel generally indicated at 20, a mounting bracket generally indicated at 22 for supporting the launch barrel 20 in a plurality of predetermined launch angles, a projectile generally indicated at 24 which is slidably received in the launch barrel 20, a resilient band 26 (FIG. 6) which is connected to the projectile 24, a plurality of retainer elements 28 (FIGS. 5 and 6), and a pressurized canister of carbon dioxide gas 30 (FIG. 6). As shown in FIG. 5 the launch barrel 20 comprises a generally rectangular body 32 having a cylindrical bore 34 formed therein having a closed end 35, and an open end 36 as shown in FIG. 5. The body 32 further has a gas port 38 as shown in FIG. 2 formed therein adjacent to the closed end 35 of the bore, and a plurality of radially extending threaded apertures 40 formed therein adjacent to the open end 36 of the bore 34. The gas port 38 permits a flow of pressurized gas into the bore 34 and the threaded apertures 40 are operative for threadedly receiving the retainer screws 28 therein. The body 32 further includes a chamfered lip portion 42 adjacent to the open end 36 of the bore 34 to facilitate insertion of the projectile 24 into the bore 34. The body 32 further includes a rectangular appendage 44 having two spaced apertures 46 which extend therethrough.

Figure 3:
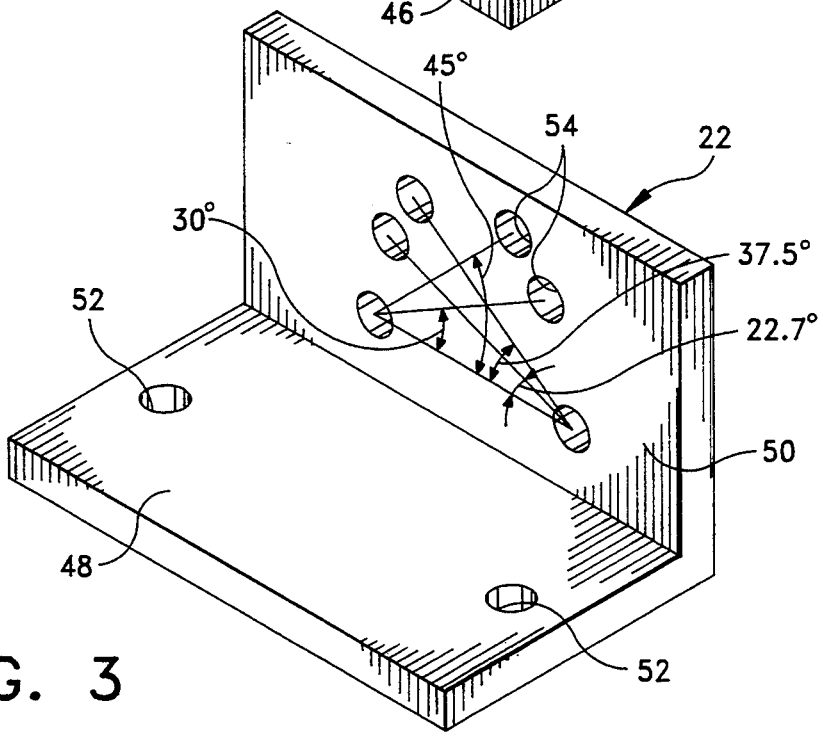
FIG. 3 is a front perspective view of the mounting bracket for the launch barrel.

The mounting bracket 22 comprises an L-shaped bracket having a horizontal leg 48 and a vertical leg 50. The horizontal leg 48 includes a pair of spaced apertures 52, and the vertical leg 50 includes six spaced apertures 54 for securing the launch barrel 20 at a plurality of different launch angles. For securing the mounting bracket 22 to a substantially horizontal supporting surface, a pair of fasteners 55 are extended through the spaced apertures 52 and secured into the supporting surface. The six apertures 54 in the vertical leg 50 of the mounting bracket 22 are arranged so as to form four different launching angles comprising 22.7°, 30°, 37.5° and 45° as illustrated in FIG. 3. The launch barrel 20 is mounted to the mounting bracket 22 by extending a pair of threaded fasteners, such as bolts 56 of FIG. 6 through the apertures 46 in the appendage 44 of the launch barrel 20 and through a corresponding pair of mounting apertures 54 in the vertical leg 50 so as to maintain the launch barrel 20 at a desired launch angle (see FIGS. 5 and 6).

Figure 4:
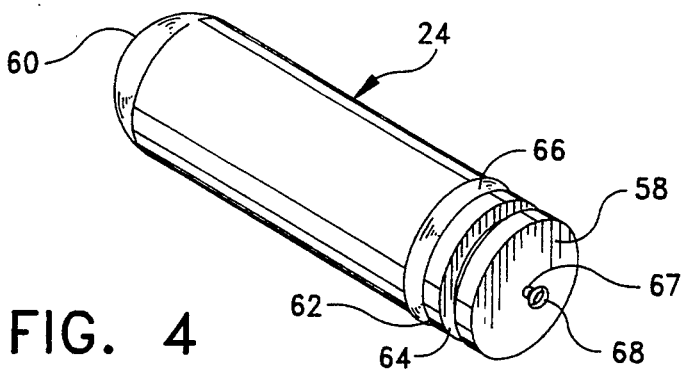
FIG. 4 is a rear perspective view of the projectile of the instant invention.

Referring now to FIG. 4, the projectile 24 comprises a substantially bullet-shaped slug having a blunt end 58, a rounded end 60, and first and second spaced circumferential grooves, 62 and 64 respectively, adjacent to the blunt end 58 thereof. The projectile 24 further includes a resilient O-ring 66 which is received in the first circumferential groove 62. The blunt end 28 of the projectile 24 includes an axially threaded bore 67 and a threaded eyelet fastener 68 which is threadedly received in the bore.

The pressurized canister of carbon dioxide gas 30 preferably comprises an 8 gram canister and it is connected to the gas port 38 by a conventional conduit 39. The conduit 39 includes a selectively actuable valve assembly 69 which is operable for selectively permitting the flow of pressurized gas into the launch barrel 20. Valve assembly 64 may be actuated by an on-site operator, or remotely by timer or control signal.

The resilient band 26 preferably comprises a rubber or elastic band one end of which is connected to the eyelet fastener 68 on the projectile 24, and the other end of which is attached to the length of wire 14.

The projectile 24 is snugly received within the cylindrical bore 34 with the rounded end 60 thereof adjacent the closed end 35 of the bore 34, and the blunt end 58 adjacent the open end 36. The O-ring 46 is operative for forming a gas tight seal between the projectile 24 and the wall of the bore 34. It is pointed out that the chamfered lip portion 42 of the body 32 facilitates insertion of the projectile 24 and O-ring 66 into the bore 34.

The retainer screws 28 preferably comprise nylon screws which are threadedly received in the radial apertures 40 in the bore 34 so as to engage within the second circumferential groove 64 in the projectile 24 (FIG. 5). In this regard, the nylon screws 28 are operative for retaining the projectile 24 within the launch tube 20 while a pressurized volume of gas is being introduced into the bore 34.

To operate the instant deployment system, the valve assembly 69 on the gas conduit 39 is selectively actuated to permit a pressurized flow of gas from the $CO_2$ canister 30 into the bore 34. The pressurized gas builds up pressure in the bore 34 to create a propulsion force which is operative for shearing the nylon screws 28 and propelling the projectile 24 outwardly of the launch tube 20. When the projectile 24 is launched, the line 14 attached to the blunt end 58 thereof by elastic 26 operates to reorient the projectile 24 so that the rounded end portion 60 faces forwardly to reduce aerodynamic drag. The elastic: band 26 is operative for stretching during the initial acceleration of the projectile 26 to prevent tensile forces from breaking the wire 14 as it is pulled from the spool 16. As the projectile 24 travels through the air, the wire 14 pays out from the spool 16 which is located adjacent to the launching tube 20. In this regard, the deployed wire 14 is laid out on the ground in a fairly straight line with no loops or bunching formed during flight. The projectile 24 is further operative for weighting the line to the ground when it lands, thereby anchoring the wire 14 so that it will not move. In the instant embodiment, the projectile travels a distance of approximately 100 feet. However, the distance travelled by the projectile 24 can be adjusted by increasing or decreasing the diameter and/or quantity of retainer screws 28, so that a greater or lesser propulsion force is required to shear the screws 28.

Figure 7:
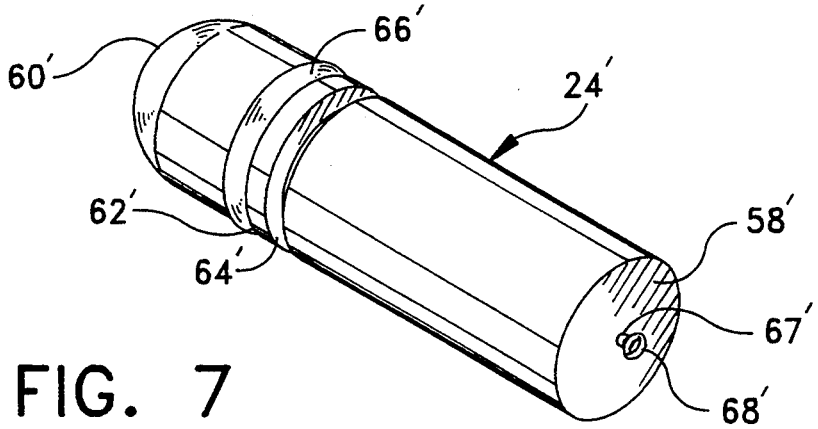
FIG. 7 is an alternative embodiment of the projectile.

In an alternative embodiment, of the projectile as shown in FIG. 7 a spool of wire could be provided inside the bore, wherein, the blunt end 58' of the projectile would be positioned adjacent to the closed end of the bore. In this embodiment, circumferential groove 64' is made near the rounded end 60' of projectile 24'. Circumferential groove 62' is made near groove 64' and closer to the blunt end 58 of projectile 24'. Operation of the second embodiment would be virtually identical to the first embodiment, with the exception that the projectile 24' is launched rounded end 60' first out of the launch barrel.

It can therefore be seen that the instant invention provides an effective gas-propelled line deployment system 10 which is compact in structure and self-contained. The system 10 is operative for deploying a wire 14 to a distance of approximately 100 feet wherein the wire 14 may be used as an antenna for a communication device. The line deployment system 10 utilizes inexpensive nylon screws 28 which allow gas pressure to build up in the launch tube 20 and then shear at a predetermined pressure to launch the projectile 24 a predetermined distance.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A line deployment system comprising:

a tubular barrel having a closed end and an open end;

means for supporting said barrel at a predetermined launch angle;

a projectile slidably received in said barrel;

means for forming a gas-tight seal between said projectile and said barrel;

a continuous length of line attached to said projectile;

means for selectively introducing a flow of pressurized gas into said barrel, said pressurized gas providing a propulsion force which is operative for propelling said projectile outwardly of said barrel; and means for retaining said projectile in said barrel until a predetermined propulsion force is achieved, said retaining means releasing said projectile at said predetermined propulsion force.

2. In the line deployment system of claim 1 said means for forming a gas-tight seal comprising a perimetric groove in said projectile and a resilient O-ring received in said groove.

3. In the line deployment system of claim 1 said means for selectively introducing a pressurized flow of gas into said barrel comprising a gas port in said barrel, a pressurized canister of gas and means for connecting said gas canister to said gas port, said means for connecting including selectively actuable valve means.

4. The line deployment system of claim 1 further comprising resilient band means interconnecting said projectile, and said wire.

5. In the line deployment system of claim 1 said retaining means comprising:

a second perimetric groove in said projectile;

a plurality of apertures extending into said barrel; and a plurality of shearable retainer elements received in said apertures so as to engage within said second groove;

said retainer elements shearing at said predetermined propulsion force to release said projectile from said barrel.

6. In the line deployment system of claim 5 said plurality of apertures being threaded, said retainer element comprising nylon screws.

7. In the line deployment system of claim 1 said support means comprising an L-shaped bracket having a horizontal leg and a vertical leg, said horizontal leg including means for securing said bracket to a supporting surface, said vertical leg including means for mounting said barrel in a plurality of different launch angles.

8. In the line deployment system of claim 7 said barrel including a body portion, said means for mounting comprising a pair of spaced apertures in said body portion, a plurality of pairs of spaced mounting apertures in said vertical leg, said pairs of mounting apertures being oriented to define a plurality of different angles, and a pair of fasteners which extend through said apertures in said body portion and through a selected pair of mounting apertures in said vertical leg.

9. A gas-propelled projectile system comprising:

a tubular barrel having a closed end and an open end;

means for supporting said barrel at a predetermined launch angle;

a projectile having first and second ends, said projectile being slidably received in said barrel;

means for forming a gas-tight seal between said projectile and said barrel;

means for selectively introducing a flow of pressurized gas into said barrel, said flow of pressurized gas providing a propulsion force which is operative for propelling said projectile outwardly of said barrel; and means for retaining said projectile in said barrel until a predetermined propulsion force is achieved, said retaining means releasing said projectile at said predetermined propulsion force.

10. In the gas-propelled projectile system of claim 9 said means for selectively introducing a pressurized flow of gas into said barrel comprising a gas port in said barrel, a pressurized canister of gas, and means for connecting said gas canister to said gas port, said means for connecting including selectively actuable valve means.

11. In the gas-propelled projectile system of claim 9 said means for forming a gas-tight seal comprising a perimetric groove in said projectile and a resilient O-ring received in said groove.

12. In the gas-propelled projectile system of claim 11 said retaining means comprising:

a second perimetric groove in said projectile;

a plurality of apertures extending into said barrel; and a plurality of shearable retainer elements received in said apertures so as to engage within said second groove;

said retainer elements shearing at said predetermined propulsion force to release said projectile from said barrel.

13. In the projectile system of claim 12 said retainer elements comprising nylon elements.

14. In the projectile system of claim 12 said plurality apertures in said barrel being threaded, said retainer elements comprising nylon screws.

* * * * *